US008404090B2

(12) United States Patent
Camire et al.

(10) Patent No.: US 8,404,090 B2
(45) Date of Patent: Mar. 26, 2013

(54) MULTI-LAYER CATHODE BLOCK

(75) Inventors: Jean Camire, Hamilton South (AU); Jules Bergeron, Jonquière (CA); Pierre-Yves Brisson, Saguenay (CA); Simon Leclerc, Jonquière (CA)

(73) Assignee: Rio Tinto Alcan International Limited, Montreal, QC (CA)

( * ) Notice: Subject to any disclaimer, the term of this patent is extended or adjusted under 35 U.S.C. 154(b) by 164 days.

(21) Appl. No.: 12/990,448

(22) PCT Filed: Apr. 30, 2009

(86) PCT No.: PCT/CA2009/000594

§ 371 (c)(1),
(2), (4) Date: Dec. 3, 2010

(87) PCT Pub. No.: WO2009/132459

PCT Pub. Date: Nov. 5, 2009

(65) Prior Publication Data

US 2011/0073470 A1 Mar. 31, 2011

Related U.S. Application Data

(60) Provisional application No. 61/049,140, filed on Apr. 30, 2008.

(51) Int. Cl.
*C25B 11/10* (2006.01)

(52) U.S. Cl. ..... 204/290.13; 204/294; 204/290.01; 204/290.03; 204/290.12

(58) Field of Classification Search ..... 204/294, 204/290.01, 290.03, 290.12, 290.13, 290.15
See application file for complete search history.

(56) References Cited

U.S. PATENT DOCUMENTS

| | | | | |
|---|---|---|---|---|
| 4,376,029 | A * | 3/1983 | Joo'et al. | 204/294 |
| 4,465,581 | A | 8/1984 | Juel et al. | |
| 7,927,518 | B2 * | 4/2011 | Dionne et al. | 252/521.4 |
| 2005/0109615 | A1 * | 5/2005 | Dionne et al. | 204/290.01 |

FOREIGN PATENT DOCUMENTS

| | | | |
|---|---|---|---|
| CA | 2354007 | A1 | 6/2000 |
| WO | 00/29644 | A1 | 5/2000 |
| WO | 03/089689 | A1 | 10/2003 |

OTHER PUBLICATIONS

International Search Report and Written Opinion mailed Aug. 5, 2009 (PCT/CA2009/000594). ISA/CA.

* cited by examiner

*Primary Examiner* — Bruce Bell
(74) *Attorney, Agent, or Firm* — Banner & Witcoff, Ltd.

(57) ABSTRACT

A multi-layer cathode block (30) for an electrolytic cell (10) has at least a surface layer (32) with a surface expansion index and a second layer (34) with a second expansion index. The surface layer (32) includes a surface wetting agent in a first total amount. The second layer (34) includes a wetting agent in a second total amount. The surface layer (32) is directly superposed to the second layer (34). The second wetting agent in the second layer (34) includes metal boride precursors that react together to generate a metal boride component in situ when the cathode block (30) is exposed to start-up and operation conditions of the electrolytic cell (10). The second total amount is lower than the first total amount and is selected so as to minimize the difference between the expansion indexes of the surface layer (32) and the second layer (34).

21 Claims, 2 Drawing Sheets

MULTI-LAYER CATHODE BLOCK

CROSS-REFERENCE TO RELATED APPLICATIONS/PRIORITY CLAIM

The present application is a U.S. National Phase filing of International Application No. PCT/CA2009/000594 filed on Apr. 30, 2009, designating the United States of America, now pending, which claims priority to U.S. Provisional Patent Application No. 61/049,140 filed on Apr. 30, 2008, both of which applications the present application claims priority to and the benefit of, and both of which applications are incorporated by reference herein in their entireties.

FIELD OF THE INVENTION

The invention relates to cathodes used in electrolytic cells. More particularly, the invention relates to multi-layer cathode structures used in reduction cells and having a wettable surface.

DESCRIPTION OF THE PRIOR ART

Metal borides, such as titanium diboride ($TiB_2$), are used in a mixture with carbon components to form ramming pastes, cell linings and cathodes for electrolytic cells. Metal borides are known to improve surface wettability of the electrolytic cell components into which they are added. Although $TiB_2$ is preferred for its superior performance in protecting the cathode against erosion and oxidation, making the cathode wettable, it has the considerable disadvantage of being very expensive.

Another method of manufacturing wettable cathode blocks is to mix metal boride precursors of, for example, metal oxides and boron oxides, with carbonaceous material to produce a composite material that forms metal boride in situ when exposed to molten metal, such as molten aluminum, in the cell, or when it is exposed to the heat of the cell at start-up and during operation. Examples of such processes are described in WO 00/29644 and WO 05/052218.

Wettable cathode blocks may include a carbonaceous material-metal boride mixture layer, having a thickness of approximately 100 millimeters (mm), bonded to a carbonaceous substrate. The carbonaceous material-metal boride mixture layer is often referred to as the surface layer. In order to reduce manufacturing costs, at least a portion of the metal boride in the surface layer can be replaced by metal boride precursors.

The carbonaceous substrate is not wettable and the operating life of the cathode block is limited by the surface layer. Moreover, differences between the composition of the surface layer and the composition of carbonaceous substrate lead to differences in their physical properties. These differences can eventually lead to surface layer cracking during baking or to delamination during operation of the electrolytic cell. To overcome these problems, WO 00/36187 describes multi-layer cathode blocks which include a carbonaceous cathode substrate and at least two coating layers of a $TiB_2$-containing composite refractory material successively over the substrate. The content of $TiB_2$ in the coating layers increases progressively as the distance between the layer and the substrate increases. The substrate does not contain $TiB_2$.

BRIEF SUMMARY OF THE INVENTION

It is therefore an aim of the present invention to address the above mentioned issues.

According to a general aspect, there is provided a multi-layer cathode block for an electrolytic cell having at least a surface layer having a surface expansion index and a second layer having a second expansion index, the surface layer including a surface wetting agent in a first total amount; and the second layer including a wetting agent in a second total amount, the surface layer being directly superposed to the second layer, the wetting agent in the second layer including metal boride precursors that react together to generate a metal boride component in situ when the cathode block is exposed to start-up and operation conditions of the electrolytic cell, the second total amount being lower than the first total amount, and selected so as to minimize the difference between the expansion indexes of the surface layer and the second layer.

According to another general aspect, there is provided a process of producing multi-layer cathode structures having at least a surface layer with a surface expansion index and a second layer with a second expansion index. The process includes the steps of: forming the second layer containing a carbonaceous material and a wetting agent in a second total amount, the wetting agent including metal boride precursors that react together to generate a metal boride component in situ when the cathode block is exposed to start-up and operation conditions of an electrolytic cell; and superposing the surface layer to the second layer, the surface layer including a surface wetting agent in a first total amount. The total amount of wetting agent in the second layer and the surface layer decreases progressively as the distance between the layer and the surface increases and the difference between the expansion indexes is selected to minimize surface cracking.

According to a further general aspect, there is provided a multi-layer cathode block for an electrolytic cell including: a surface layer including a surface wetting agent and having a thickness ranging between 2 and 8 centimeters; and a second layer including metal boride precursors that react together to generate a metal boride component in situ when the cathode block is exposed to start-up and operation conditions of the electrolytic cell, the surface layer being directly superposed to the second layer.

BRIEF DESCRIPTION OF THE DRAWINGS

It will be noted that throughout the appended drawings, like features are identified by like reference numerals.

DETAILED DESCRIPTION

Figure 1:
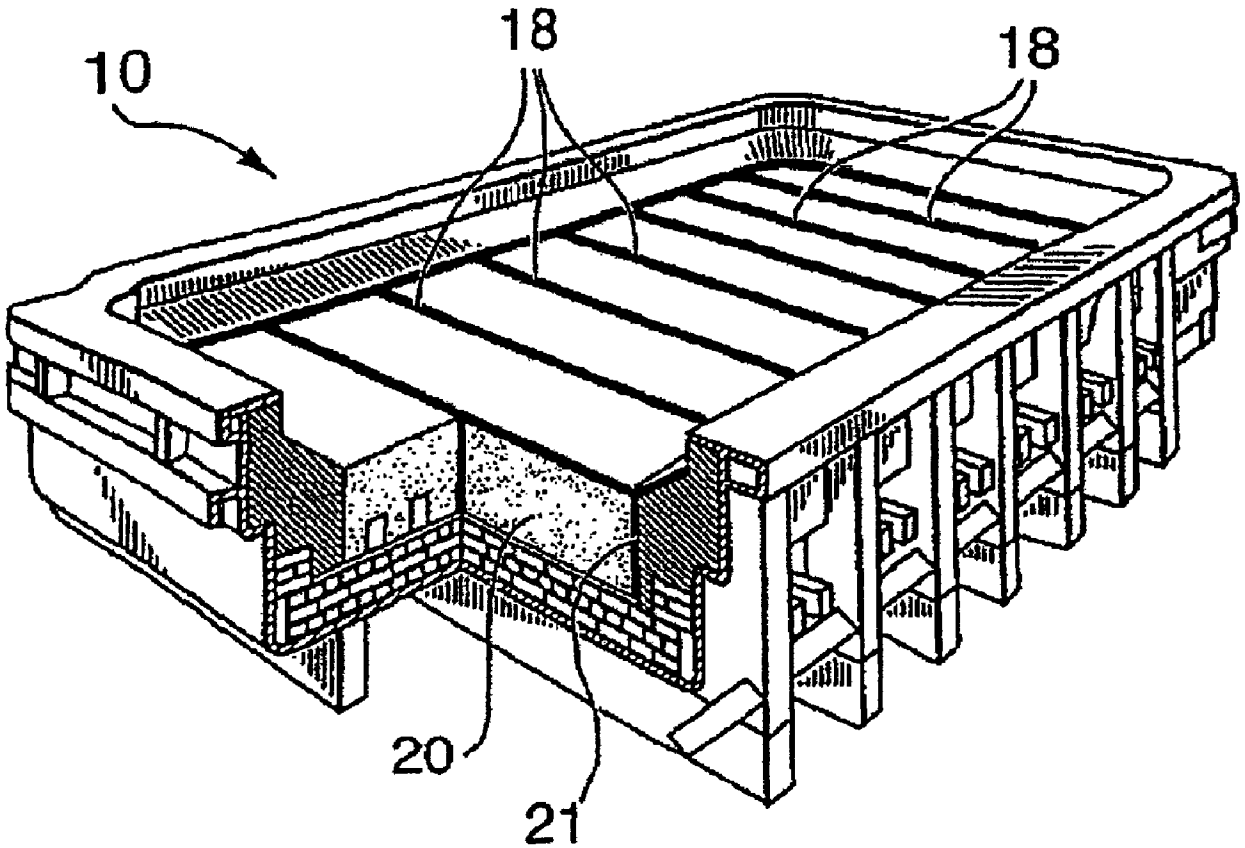
FIG. 1 is a perspective view, partially cut-away, of a conventional aluminum reduction cell with which the invention can be used.

With reference to FIG. 1, a conventional reduction cell 10 includes cathode blocks 20. The cathode blocks 20 are separated by gaps 18 being filled with ramming paste 21. Molten electrolyte contacts the cathode and the ramming paste 21, and a layer of molten aluminum forms on the cathode.

Figure 2:
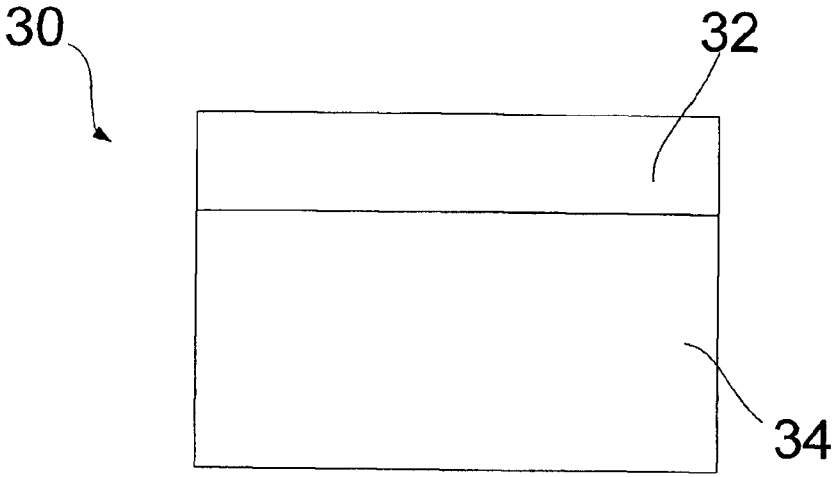
FIG. 2 is a schematic cross-section of a cathode block having two superposed layers.

FIG. 2 illustrates an embodiment of a multi-layer cathode block 30 with two superposed layers 32, 34, i.e. a surface layer 32 in contact with the molten aluminum and a base layer 34. The surface layer 32 is directly superposed to the base layer 34.

The material of each layer 32, 34 includes a wetting agent. In the surface layer 32, the wetting agent includes a metal boride, metal boride precursors or a combination of a metal boride and metal boride precursors. The metal boride precursors react together to generate a metal boride component in situ when the cathode block is exposed to start-up and operation conditions of the electrolytic cell. In the base layer 34, the wetting agent includes metal boride precursors. It can also include a combination of a metal boride and metal boride precursors.

In a preferred embodiment, the surface layer 32 includes a combination of a metal boride and metal boride precursors while the base layer 34 includes solely metal boride precursors.

The wetting agent is included in the surface layer material in a first total amount (or content) and in the base layer material in a second total amount (or content). The total amounts correspond to the sum of metal boride and metal boride precursors present in each layer. The second total amount of wetting agent, i.e. in base layer 34, is lower than or equal to the first total amount, i.e. in surface layer 32.

The metal of the metal boride can be selected from a group including titanium, zirconium, vanadium, hafnium, niobium, tantalum, chromium and molybdenum. In a preferred embodiment, the metal of the metal boride is titanium and the metal boride is $TiB_2$.

In an embodiment, metal boride precursors include a metal oxide and boric oxide ($B_2O_3$) wherein the metal oxide and the boric oxide are physically linked in clusters and the boric oxide is intimately supported by the metal oxide. The boric oxide of the precursor mixture can be produced from a boron component selected from the group consisting of ortho-boric acid ($H_3BO_3$) and meta-boric acid ($HBO_2$). The metal oxide can have a particle structure with pores and the boric oxide is found within the pores.

In alternative embodiments, metal boride precursors can include, for instance and without being limitative, the precursors disclosed in US patent application published under No. 2005/0109615 or in international patent application WO 00/29644.

The metal of the metal oxide can be selected from a group including titanium, zirconium, vanadium, hafnium, niobium, tantalum, chromium and molybdenum. In a preferred embodiment, the metal in the metal oxide is titanium.

EXAMPLE 1

Bilayer Cathode Block

For example and without being limitative, in a bilayer cathode block, the surface layer includes 30 wt % of $TiB_2$ as metal boride and 10 wt % of metal boride precursors and the base layer is metal boride free and includes 20 wt % of metal boride precursors. The metal boride precursors include titanium as metal. Thus, the first total amount, i.e. 40 wt %, is higher than the second total amount, i.e. 20 wt %.

EXAMPLE 2

Bilayer Cathode Block

In another non-limitative embodiment, the surface layer includes 35 wt % of $TiB_2$ as metal boride and 15 wt % of metal boride precursors and the base layer is metal boride free and includes 20 wt % of metal boride precursors. The metal boride precursors include titanium as metal. Thus, the first total amount, i.e. 50 wt %, is higher than the second total amount, i.e. 20 wt %.

As will be described in more detail below, the cathode layer materials are superposed to one another in a mould and are baked before being inserted in an electrolytic cell. During baking and electrolytic cell operation, differences between the composition of the cathode layers lead to differences in their physical properties. More particularly, each cathode layer expands during baking and electrolytic cell operation. Differences between the expansion of both layers can eventually lead to cracking during baking and/or delamination during operation of the electrolytic cell.

Thus, the difference between the expansion indexes of two superposed cathode layers should be controlled in order to minimize the expansion difference during baking and electrolytic cell operation, preventing cracking and/or delamination.

In an embodiment, the expansion index can be evaluated as the size variation of a cathode layer due to exposure to heat and sodium absorption in the cathode block. For instance, it can be measured with a Rapoport-Samoilenko-type test. It can also be measured by comparing cathode layer size before and after baking or by comparing cathode layer maximum size reached and cathode layer size before heating. The expansion index can also be created through a combination of several expansion measures.

Thus, in accordance with the invention, the amount of wetting agent in two superposed cathode layers and their kinds are controlled to minimize the difference between the expansion indexes.

Figure 3:
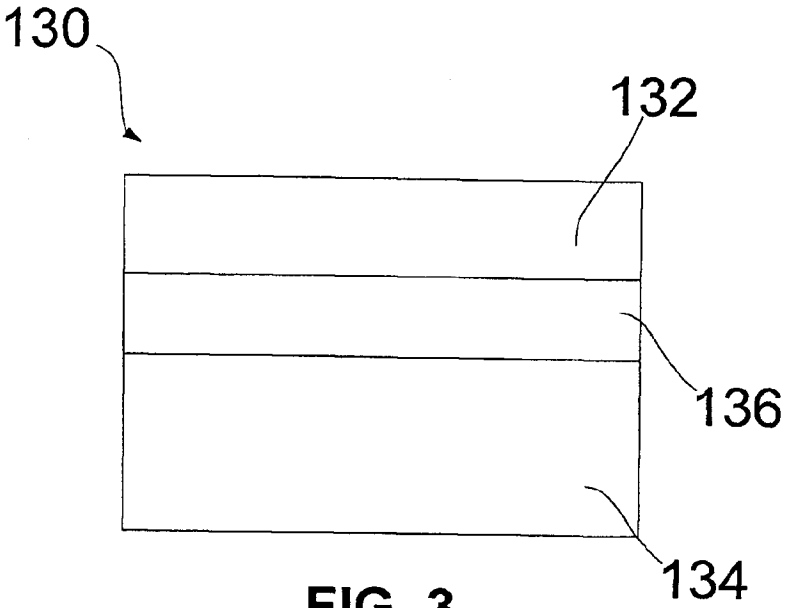
FIG. 3 is a schematic cross-section of a cathode block having three superposed layers.

FIG. 3 illustrates another schematic embodiment of a multi-layer cathode block 130 with three superposed layers, i.e. a surface layer 132, a base layer 134, and an intermediate layer 136 extending between the surface layer 132 and the base layer 134. The features are numbered with reference numerals which correspond to the reference numerals of the previous embodiment in the 100 series.

The surface layer material and the intermediate layer material of the multi-layer cathode block 130 include a wetting agent. The base layer material can include a wetting agent or can be wetting agent free.

In the surface layer 132, the wetting agent includes a metal boride, metal boride precursors or a combination of a metal boride and metal boride precursors. In the intermediate layer, the wetting agent includes metal boride precursors. It can also include a combination of a metal boride and metal boride precursors. Finally, in the base layer 34, the wetting agent, if any, includes metal boride precursors. It can also include a combination of a metal boride and metal boride precursors.

In a preferred embodiment, the surface layer 32 includes a combination of a metal boride and metal boride precursors, while the intermediate layer 36 and the base layer 34 include solely metal boride precursors.

The wetting agent is included in the surface layer material in a first total amount and in the intermediate layer material in a second total amount. The second total amount of wetting agent is lower than or equal to the first total amount.

If the base layer material includes a wetting agent, the wetting agent is included in a third total amount which is lower than or equal to the second total amount.

EXAMPLE 3

Tri-Layer Cathode

For example and without being limitative, the surface layer includes 40 wt % of $TiB_2$ as metal boride and 10 wt % of metal boride precursors, the intermediate layer includes 15 wt % of $TiB_2$ as metal boride and 15 wt % of metal boride precursors, and the base layer is metal boride free and includes 20 wt % of metal boride precursors. For the three layers, the metal of the metal boride precursors is titanium. Thus, the first total amount, i.e. 50 wt %, is higher than the second total amount, i.e. 30 wt %. Moreover, the second total amount is higher than the third total amount, i.e. 20 wt %.

As described above for the two-layered cathode block 30, the amounts of wetting agent between two superposed cathode layers are controlled to minimize the difference between the expansion indexes of superposed layers. Thus, the amounts of wetting agent between the surface 132 and the intermediate layers 136 and their kinds are controlled in order to minimize the difference between their respective expansion indexes. Similarly, the amounts of wetting agent between the intermediate 136 and the base layers 134 and their kinds are controlled to minimize the difference between their respective expansion indexes.

In alternative embodiments (not shown), the multi-layer cathode block can include a plurality of superposed intermediate layers extending between the surface layer and the base layer.

Typically, the cathode block has an approximate total thickness ranging between 300-500 millimeters (mm) and the surface layer has an approximate thickness ranging between 20 and 150 mm. The intermediate layer(s), if any, has an approximate thickness ranging between 20 and 150 mm. The thickness of the base layer depends on the total thickness of the cathode block and the thickness of the layer(s) extending above, i.e. the base layer thickness constitutes the remainder of the cathode block thickness.

The content of wetting agent in the surface layer, i.e. the first total amount, can range between 20 and 95 wt %, for instance. The remainder includes a carbonaceous component, for example and without being limitative, a mixture of anthracite, graphite, tar, and pitch. Typically, the surface layer has a higher wetting agent content if it includes solely metal boride, i.e. it is metal boride precursors free. On the other hand, the surface layer typically has a lower wetting agent content if it includes metal boride precursors or mixtures of metal boride and metal boride precursors.

For example and without being limitative, for a surface layer including $TiB_2$ as metal boride and for metal boride precursors including titanium as metal, the wetting agent content of the base layer can range between 0 wt %, if the cathode block includes an intermediate layer, and 90 wt %. If the cathode block does not include an intermediate layer, if the surface layer includes $TiB_2$ as metal boride, and if metal boride precursors include titanium as metal, the wetting agent content of the base layer can range between 5 wt % and 90 wt %. In an embodiment, if the cathode block does not include an intermediate layer and if the surface layer includes metal boride precursors and $TiB_2$ as metal boride, the wetting agent content of the base layer can range between 5 wt % and 40 wt %. The remainder includes a carbonaceous component, for example and without being limitative, a mixture of anthracite, graphite, tar, and pitch.

In an embodiment, the cathode block is formed in a mould having closed sides and bottom and an open top. The base layer material, including the base wetting agent, is placed at the bottom of the mould and the top surface of the base layer material is then roughened, e.g. by drawing a rake across the surface. The tines of the rake form grooves on the surface of the base layer material. At least one layer of another material, i.e. the surface layer material, is placed over the raked base layer and a weight, which is the full internal dimension of the mould, is placed on top of the cathode material.

The entire mould unit is then vibrated to compress the material into a green cathode shape, which is then baked and machined prior to insertion into an electrolysis cell. In addition to compaction, the vibration step also causes some mixing of the material, resulting in a mixed area which is actually thicker than the depths of the grooves formed in the substrate.

A typical commercial cathode block has dimensions of about 430 mm high, 490 mm wide, and 1310 mm long, for instance and without being limitative. When the multi-layer cathode block includes more than two layers, it is desirable to rake the top surface of each layer before applying a further layer.

EXAMPLE 4

A bilayer cathode block, such as the one shown in FIG. 2, includes a surface layer containing a total amount of wetting agent between 20 and 50 wt % of the cathode block. The wetting agent includes $TiB_2$ as metal boride and titanium as metal for the metal boride precursors. For example and without being limitative, the surface layer includes 35 wt % of $TiB_2$ and 15 wt % of titanium oxide ($TiO_2$) and boric oxide ($B_2O_3$) as metal boride precursors, for a total content of 50 wt %.

The base layer contains a total amount of wetting agent between 10 and 20 wt %. For example and without being limitative, the base layer includes 20 wt % of titanium oxide ($TiO_2$) and boric oxide ($B_2O_3$) as metal boride precursors, and be metal boride free.

The difference between expansion indexes of directly superposed layers is important in avoiding cracking of the cathodes. The use of multiple layers of varying wetting agent content further aids in preventing cracking of the final cathode. Moreover, adding metal boride precursors to the layer extending directly below the surface layer minimizes the difference between the expansion indexes of both superposed layers.

Compared to prior art cathode blocks, by adding metal boride precursors to at least one layer extending directly below the surface layer, the thickness of the surface layer can be reduced due to less strength requirement to resist cracking. For example and without being limitative, the surface layer thickness can be reduced from 100 mm to 20 mm. Moreover, if desired, the wetting agent content and, more particularly, the metal boride content of the surface layer can be increased while still maintaining an economic viability. For example and without being limitative, the metal boride content can be increased from 50 wt % to 90 wt % in a surface layer having a reduced thickness.

Alternatively, the wetting agent content and, more particularly, the metal boride content in the surface layer can be reduced if the thickness of the surface layer is substantially not modified compared to prior art cathodes. For example and without being limitative, for a 100 mm surface layer, the metal boride content can be reduced from 50 wt % to 30 wt %.

Moreover, the surface layer can be metal boride free and can include solely metal boride precursors. For example and without being limitative, the metal boride precursor content in the surface layer can range between 20 and 30 wt %. Addition of metal boride precursors in the surface layer is facilitated by the presence of precursors in the intermediate layer and/or the base layer.

Adding metal boride precursors to at least one layer extending directly below the surface layer of the cathode block reduces the difference between the physical properties of the cathode layers, particularly expansion during baking, and therefore reduces the occurrence of cracking. Moreover, adding metal boride precursors to the cathode layer extending below the surface layer increases the operating life of the cathode block since the resulting layer is also wettable by molten metal.

It is appreciated that the multi-layer cathode block can be used in aluminum electrolytic cells but it can also be used in reduction cells for other metals.

The embodiments of the invention described above are intended to be exemplary only. The scope of the invention is therefore intended to be limited solely by the scope of the appended claims.

The invention claimed is:

1. A multi-layer cathode block for an electrolytic cell having at least a surface layer having a surface expansion index and a second layer having a second expansion index:

the surface layer including a surface wetting agent in a first total amount; and the second layer including a wetting agent in a second total amount, the surface layer being directly superposed to the second layer and configured to form a surface in contact with molten aluminum in the electrolytic cell, the wetting agent in the second layer including metal boride precursors that are configured to react together to generate a metal boride component in situ when the cathode block is exposed to start-up and operation conditions of the electrolytic cell, the second total amount being lower than the first total amount, and selected so as to minimize the difference between the surface expansion index and the second expansion index.

2. A multi-layer cathode block as claimed in claim 1, having a third layer having a third expansion index, the third layer including a wetting agent in a third total amount, the second layer being directly superposed to the third layer, the wetting agent in the third layer including metal boride precursors that react together to generate a metal boride component in situ when the cathode block is exposed to start-up and operation conditions of the electrolytic cell, the third total amount being lower than the second total amount, and selected so as to minimize the difference between the second expansion index and the third expansion index.

3. A multi-layer cathode block as claimed in claim 1, wherein the surface wetting agent and the wetting agent are selected from the group consisting of: a metal boride, metal boride precursors, and mixtures of the metal boride and metal boride precursors.

4. A multi-layer cathode block as claimed in claim 3, wherein the wetting agent in the second layer includes a metal boride and metal boride precursors.

5. A multi-layer cathode block as claimed in claim 3, wherein the wetting agent in the second layer includes metal boride precursors substantially free of metal boride.

6. A multi-layer cathode block as claimed in claim 3, wherein the metal boride is $TiB_2$ and the second total amount ranges between 5 wt % and 90 wt %.

7. A multi-layer cathode block as claimed in claim 1, wherein the surface wetting agent includes a metal boride and metal boride precursors.

8. A multi-layer cathode block as claimed in claim 7, wherein the metal boride is $TiB_2$ and the first total amount ranges between 20 and 50 wt %.

9. A multi-layer cathode block as claimed in claim 7, wherein the metal boride is $TiB_2$ and the first total amount ranges between 20 and 80 wt % including between 0 and 50 wt % of $TiB_2$ and between 0 and 30 wt % of metal boride precursors.

10. A multi-layer cathode block as claimed in claim 7, wherein the metal boride is $TiB_2$ and the second total amount ranges between 5 and 40 wt %.

11. A multi-layer cathode block as claimed in claim 7, wherein the wetting agent in the second layer includes between 0 and 40 wt % of $TiB_2$ and between 5 and 30 wt % of metal boride precursors.

12. A multi-layer cathode block as claimed in claim 1, wherein the surface wetting agent includes a metal boride substantially free of metal boride precursors.

13. A multi-layer cathode block as claimed in claim 1, wherein the surface wetting agent includes a metal boride, and the metal of the metal boride is selected from the group consisting of titanium, zirconium, vanadium, hafnium, niobium, tantalum, chromium, and molybdenum.

14. A multi-layer cathode block as claimed in claim 13, wherein the metal boride is $TiB_2$.

15. A multi-layer cathode block as claimed in claim 14, wherein the first total amount ranges between 20 and 95 wt %.

16. A multi-layer cathode block as claimed in claim 1, wherein the surface wetting agent includes metal boride precursors and the metal boride precursors include a metal oxide and boric oxide wherein the metal oxide and the boric oxide are physically linked in clusters and the boric oxide is intimately supported by the metal oxide.

17. A multi-layer cathode block as claimed in claim 16, wherein the metal of the metal oxide is titanium.

18. A multi-layer cathode block as claimed in claim 1, wherein the metal boride precursors of the wetting agent in the second layer include a metal oxide and boric oxide wherein the metal oxide and the boric oxide are physically linked in clusters, and the boric oxide is intimately supported by the metal oxide.

19. A multi-layer cathode block as claimed in claim 18, wherein the metal of the metal oxide is titanium.

20. A process of producing multi-layer cathode structures having at least a surface layer with a surface expansion index and a second layer with a second expansion index, the process includes the steps of:

forming the second layer containing a carbonaceous material and a wetting agent in a second total amount, the wetting agent including metal boride precursors that react together to generate a metal boride component in situ when the cathode block is exposed to start-up and operation conditions of an electrolytic cell; and superposing the surface layer to the second layer such that the surface layer forms a surface in contact with molten aluminum in the electrolytic cell, the surface layer including a surface wetting agent in a first total amount, wherein the total amount of wetting agent in the second layer and the surface layer decreases progressively as the distance between the layer and the surface increases and the difference between the surface expansion index and the second expansion index is selected to minimize surface cracking

21. A multi-layer cathode block for an electrolytic cell including:

a surface layer including a surface wetting agent and having a thickness ranging between 2 and 8 centimeters and configured to form a surface in contact with molten aluminum in the electrolytic cell; and a second layer including metal boride precursors that are configured to react together to generate a metal boride component in situ when the cathode block is exposed to start-up and operation conditions of the electrolytic cell, the surface layer being directly superposed to the second layer.

* * * * *